United States Patent [19]

Gehin

[11] Patent Number: 4,667,205

[45] Date of Patent: May 19, 1987

[54] WIDEBAND MICROWAVE ANTENNA WITH TWO COUPLED SECTORAL HORNS AND POWER DIVIDERS

[75] Inventor: Claude Gehin, Verrieres-le-Buisson, France

[73] Assignee: Thomson-CSF, Paris, France

[21] Appl. No.: 581,416

[22] Filed: Feb. 17, 1984

[30] Foreign Application Priority Data

Feb. 22, 1983 [FR] France ..... 83 02836

[51] Int. Cl.[4] ..... H01Q 13/02

[52] U.S. Cl. ..... 343/783; 343/786

[58] Field of Search ..... 343/786, 785, 783, 772, 343/777

[56] References Cited

U.S. PATENT DOCUMENTS

| | | | |
|---|---|---|---|
| 2,415,807 | 2/1947 | Barrow | 343/786 |
| 2,650,985 | 9/1953 | Rust et al. | 343/786 |
| 2,692,336 | 10/1954 | Kock | 343/786 |
| 2,743,440 | 4/1956 | Riblet | 343/786 |
| 2,920,322 | 1/1960 | Brown | 343/786 |
| 3,171,129 | 2/1965 | Nowakowski et al. | 343/786 |
| 3,530,482 | 9/1970 | Palmer | 343/786 |
| 3,653,055 | 3/1972 | Wu et al. | 343/786 |
| 3,831,176 | 8/1974 | Epis et al. | 343/786 |
| 4,349,827 | 9/1982 | Bixler et al. | 343/786 |

FOREIGN PATENT DOCUMENTS

| | | | |
|---|---|---|---|
| 1010123 | 6/1957 | Fed. Rep. of Germany . | |
| 992117 | 10/1951 | France . | |
| 2090068 | 6/1982 | United Kingdom | 343/786 |

OTHER PUBLICATIONS

Landstorfer et al, "Side Lobe Reduction with Horn Antennas", IEEE, 1979, Int'l Symposium Digest, Antennas and Prop., vol. 2, 6-1979, pp. 718-721.

*Primary Examiner*—Eli Lieberman
*Assistant Examiner*—Michael C. Wimer
*Attorney, Agent, or Firm*—Cushman, Darby & Cushman

[57] ABSTRACT

A wide-band microwave antenna capable of radiating over a wide angular field is fed by a rectangular wave guide and includes a first sectoral horn coupled to the rectangular wave guide. The first sectoral horn is sectoral in the H plane. Coupled to the first sectoral horn is a second sectoral horn which is sectoral in the E plane. The second sectoral horn has a partial-cylindrical-shape with circular-shaped outer edges. The second sectoral horn has a top plate and a bottom plate. A plurality of equally spaced power distributors are radially disposed in the second sectoral horn and extend from the top plate to the bottom plate through the entire length of the second sectoral horn. These power distributors thus form a plurality of elementary radiation sources.

12 Claims, 6 Drawing Figures

FIG_3·a
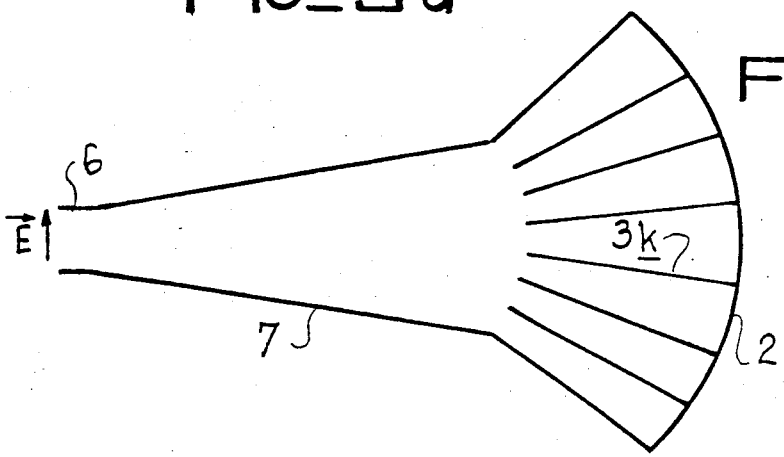
FIG_3·b
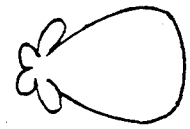
FIG_4·a
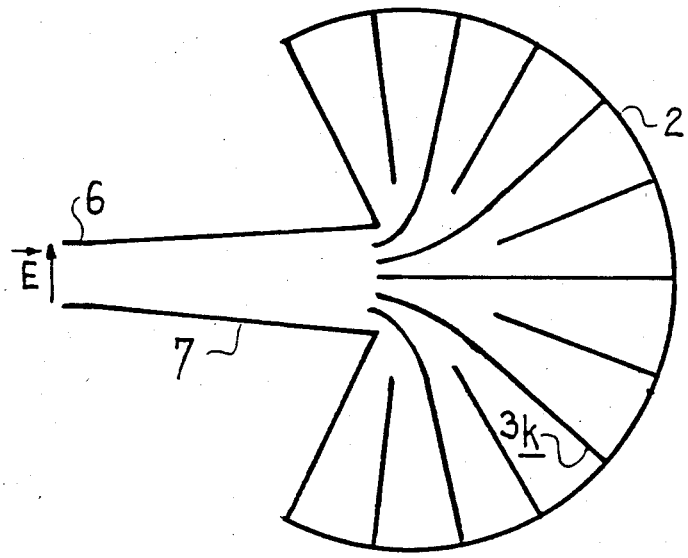
FIG_4·b
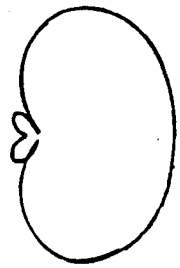

WIDEBAND MICROWAVE ANTENNA WITH TWO COUPLED SECTORAL HORNS AND POWER DIVIDERS

BACKGROUND OF THE INVENTION

The present invention concerns a wide band hyperfrequency (microwave) antenna broadly radiating in a plane.

In the field of listening systems and radar signal wide band detection systems or radar signal scrambling systems, it is necessary to use an antenna presenting a wide radiating pattern in one of its principal planes, (used for a plan position indicator, for example), and constant on a considerable bandwidth. The pattern can be formed in any principal plane, according to needs.

DESCRIPTION OF THE PRIOR ART

Two known types of antennae exist, the radiating patterns of which are independent of the frequency:

The antennae of the first type have an exponential structure or logarithmic periodicity structure; the directivity obtained is the same for both principal planes. But certain technological problems linked to the operating range or to the level of the radiated power prevent the total control of the width of the pattern and therefore these types of antennae do not always meet the requirements concerning directivity and polarization.

The antennae of the second type are of the radiating opening type. They are limited as concerns the frequency range and directivity possibilities. Among the radiating opening antennae the horns are adapted to medium or wide directivities. The width of the beam radiated by the horns varies as a function of the wavelength and therefore as a function of the frequency. Variations of the beam width as a function of the frequency can be minimized in different ways. However, the compensation techniques used limit the operating range. Some examples of these types of compensation techniques are as follows:

for wave guides that present a progressive lengthening of the large sides, i.e. a widening out in the magnetic field $\overline{H}$ plane, these guides being called sectoral horns in the plane H, the differences in wave paths can be minimized by using a very long horn which increases the bulkiness of the antenna. If the horn is short, compensation can be accomplished by a dephasing on the opening of the horn that limits the variations of the beam width in the frequency range.

also compensation can be accomplished by grooves. It is this technique known as "corrugated" horn. The band width of this type of horn is smaller than or equal to an octave, which is very insufficient.

compensation accomplished by diffracting elements (such as metallic bars in front of the opening, metallic shutters flanking either side of the opening, etc.) provides performance stability that hardly exceeds a band width of one octave. Furthermore, the directivity pattern can present defects.

The limitations observed with the compensation means mentioned herein-above are due to the fact that it is difficult to control the distribution of the field at the radiating opening. The distribution of the field is indeed often imposed by the method of excitation of the opening, for example, as in a case of excitation provided by a wave guide, by the method of propagation in the guide.

This distribution can be modified by different means that limit the band and are only appropriate for particular directivities.

SUMMARY OF THE INVENTION

In order to overcome the problems raised in the introduction to the present description, namely obtaining on a wide frequency band a pattern that in a given plane can cover a very wide angular field. The antenna according to the invention comprises a sectoral horn in the said plane, with a cylindrical radiating opening and having internal radial partitions forming a plurality of elementary radiation sources, the respective amplitudes of which can be adjusted in such a way that the sectoral horn radiates according to the required distribution amplitude.

According to the invention, the wide band hyperfrequency antenna, is excited by an electromagnetic wave propagated by a rectangular wave guide, the small and the large sides of the guide being respectively parallel to two orthogonal reference planes. The antenna comprises a radiating part constituted by a first horn that is sectoral in the first of the reference planes, the mouth of the horn has an equiphase distribution and has the shape of a cylindrical sector having an axis (a directrix or guide-line) orthogonal to the said first reference plane. The partitions are radially disposed, inside and substantially along all the height of the first sectoral horn and define, with the lateral walls of the sectoral horn, a plurality of radiating elementary sources. The directivity of the horn, in the first reference plane, is determined by the opening angle of the cylindrical sector forming the first sectoral horn.

The object of the instant invention is to provide a wide band microwave antenna which allows a wide variety of directivities in the first reference plane to be obtained, depending on the angle of opening, and protruding or recessing of the cylindrical section in the first reference plane.

BRIEF DESCRIPTION OF THE DRAWINGS

Other advantages and characteristics of the antenna according to the invention will appear from reading through the following detailed description made with reference to the annexed figures which represent:

FIGS. 3*a* and 4*a* show another variant of the antenna according to the invention for two different dierctivities, their radiating patterns being schematically represented by FIGS. 3*b* and 4*b* respectively.

DESCRIPTION OF THE PREFERRED EMBODIMENTS

Figure 1:
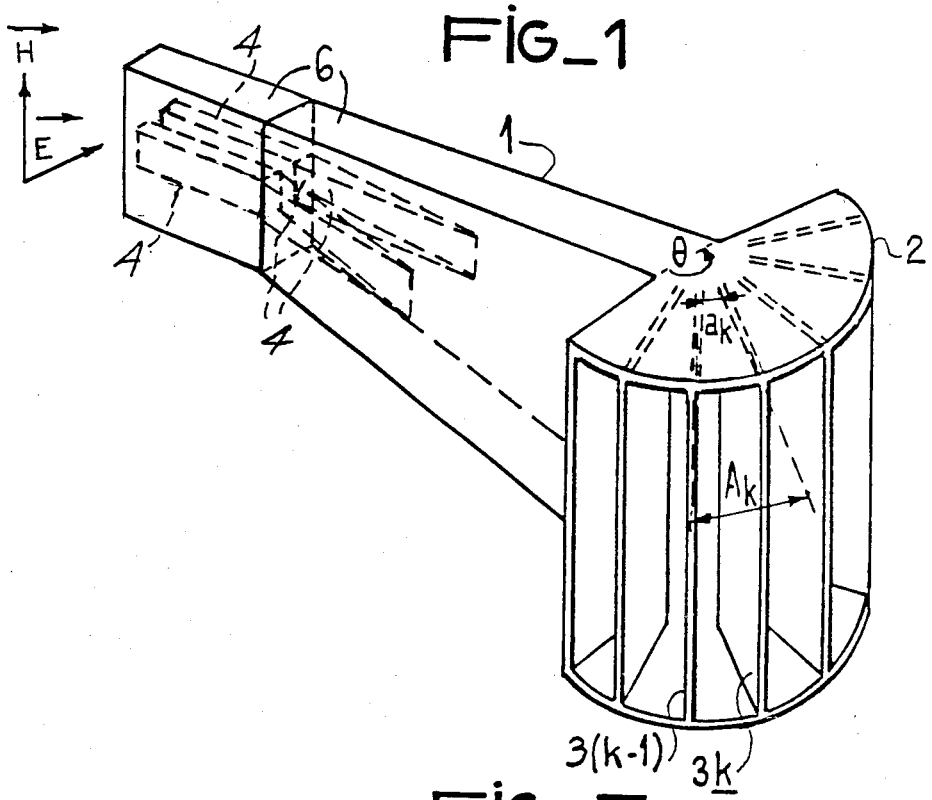
FIG. 1 shows a perspective view of an antenna according to the invention.

The same reference numerals are used in the Figures to designate identical elements or elements fulfilling the same function.

In non-limitative embodiments represented by the Figures and described herein-under, a first and a second reference plane are chosen parallel respectively to the electric field E and to the magnetic field H of an electromagnetic wave that is propagating in a wave guide 6 and which excites the source according to the invention. It is supposed in the following description that the antenna is required to cover on a wide frequency band with a large angular field in the first reference plane.

The antenna according to the invention, represented in perspective by FIG. 1, comprises a sectoral horn or cornet 1 in the plane H, i.e. a rectangular wave guide presenting an enlargement in the plane of the field $\vec{H}$. The sectoral horn 1 widens out into the electric field $\vec{E}$ plane in a horn 2 which is sectoral in the plane E and has the form of a cylindrical sector, the directrix (or axis) of which is parallel to the field $\vec{H}$. A plurality of N internal partitions 3*l*, . . . 3*k*, . . . 3N are radially disposed in the cylindrical sector 2 from the throat of the horn to its mouth. The pattern (not represented) of such an antenna covers, in the plane E of the horn, a very large angular field which is substantially constant on a fairly wide frequency band. According to the opening angle $\theta$ of the cylindrical sector, a semi-omnidirectional coverage can be obtained. The frequency band may be widened through the use of an excitation guide 6 with steps 4 of variable height and length, disposed on the internal walls of the sectoral horn 1 on the sides of the plane H of the horn.

The outline of the cylindrical sector 2 can be an arc of a circle as in the figures, but can also present other forms.

The N partitions $3_1$, . . . 3*k*, . . . 3N act as power distributors. The cylindrical opening of the horn 2 can thus be considered as a network or antennae of (N+1) elementary sources of the order k comprised between 1 to N+1, the respective amplitude of which can be modified. An elementary source is limited by two partitions or one partition and a lateral wall of the horn 2. In the figures, $a_k$(k=2 to N) designates the spacing between two partitions 3(k−1) and 3*k* on the side of the cylindrical horn 2 adjacent the sectoral horn 1, and $A_k$(k=2 to N) designates the radiating opening comprised between the two partitions 3(k−1) and 3*k* involved, on the radiating external face of the antenna. Similarly, $a_1$ and $A_1$ designates the spacings between the partition $3_1$ and the lateral wall of horn 2, at the inlet and at the opening of the horn 2 respectively, and $a_{N+1}$ and $A_{N+1}$ designate the spacings between the partition 3N and the lateral wall of horn 2, at the inlet and at the opening of the horn 2 respectively. As used herein, the term horn throat refers to the section of horn 2 which couples to horn 1. Likewise, the term horn mouth refers to the output portion of horn 2.

The spacing $a_k$ of order k determines the amplitude of the field at the radiating opening of the radiating elementary source of order k cut in the cylindrical horn 2.

The spacings $A_1$, . . . $A_k$, . . . $A_{N+1}$ must be selected to satisfy proper operating conditions of the radiating antenna network: they must be on the order of $\lambda_M/2$, $\lambda_M$ being the wavelength corresponding to the maximum operating frequency of the antenna.

Furthermore, the antenna represented by FIG. 1, with or without steps 4, can operate on a wide frequency band if the width of the outlet face of the cylindrical horn 2, (namely if the sum $$\sum_{k=1}^{N+1} Ak$$

of the spacings between partitions or partitions and lateral walls of the cornet 2), is large enough with respect to the wavelength $\lambda_m$, for example in the order of $2\lambda_m$ to $3\lambda_m$, $\lambda_m$ being the wavelength corresponding to the minimal operating frequency.

Figure 2:
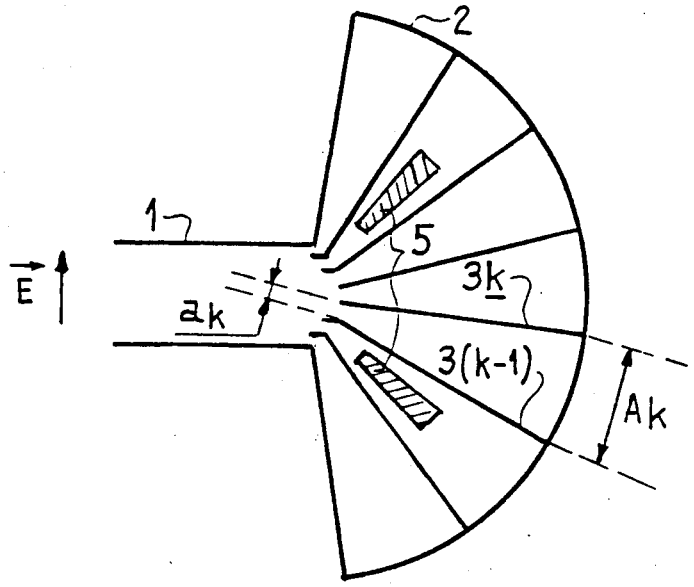
FIG. 2 shows a partial sectional view of a variant of the antenna of FIG. 1.

FIG. 2 represents a partial transverse sectional view in plane E of the source of FIG. 1. The excitation wave guide 6 and a part of the sectoral horn 1 are not represented. While the antenna of FIG. 1 is at equiphase distribution, in addition to the elements of FIG. 1 that bear the same references, the antenna according to the invention can, as illustrated by FIG. 2, include phase shifters 5 which are disposed between certain partitions. Each phase shifter 5 allows adjustment of the phase of the radiating elementary antenna constituted by the part of the cylindrical sector 2 comprised between the two partitions or one partition and one lateral wall surrounding the phase shifter 5 involved. The phase shifter 5 can be of the type with a dielectric blade, for example.

The wide band antenna represented by FIGS. 1 and 2 therefore acts as a network of (N+1) elementary antennae or sources distributed on a cylindrical sector, the amplitude law of which can be modified by adjusting the spacings $a_k$ between partitions and eventually the phase law by inserting phase shifters 5 between certain partitions.

FIGS. 3*a* and 4*a* represent partial schematic sections in the plane E of variants of the antenna according to the invention. The antennae that present the disposition illustrated by FIGS. 3*a* and 4*a* respectively, have different directivities as shown by their radiating patterns represented schematically by corresponding FIGS. 3*b* and 4*b*.

The antenna of FIG. 3*a* presents a medium directivity. That of FIG. 4*a* is semi-omnidirectional. In both cases, a pyramidal horn 7 (i.e. sectoral in planes E and H) connects the excitation wave guide 6 (provided or not provided with steps) to the cylindrical sector 2 forming a horn provided with positions $3_1$, . . . , 3*k*, . . . 3N. The opening angle $\theta$ (the definition of which is indicated in the description of FIG. 1 but which is not recalled in FIGS. 3*a* and 3*a* in order not to complicate them) of the cylindrical horn 2 is about 90° in the antenna of FIG. 3*a* at medium directivity but is wider than 180° in the case of the semiomnidirectional antenna of FIG. 4*a*.

Considering the large number of partitions in the antenna of FIG. 4*a*, the large dimensions of the cylindrical horn 2, and the operating conditions mentioned herein-above which bearing on the dimensions of the cylindrical horn, only certain partitions are extended up to the excitation face of the cylindrical horn 2 at its junction with the pyramidal horn 7.

As with the embodiment of FIG. 1, the frequency band can be increased through the use of an excitation wave guide 6 having steps. The steps 4 (not represented) are then disposed on the walls, parallel to the field H of the guide 6 and of the pyramidal horn 7.

An antenna is thus described hereinabove the radiating pattern of which can be made wide in a plane (plane E in the Figures) and is independent of the frequency on a wide frequency band.

The present invention is applicable, for example, to goniometric antennae, or to wide band or k band or scrambling antennae.

I claim:

1. A wide band microwave antenna adapted to be fed by a rectangular waveguide, comprising:

a first sectoral horn coupled to said rectangular waveguide and being sectoral in an $\vec{H}$ plane;

a second sectoral horn being sectoral in an $\vec{E}$ plane and having a partial-cylindrical shape and an axis substantially normal to said $\vec{E}$ plane, two side walls forming an opening angle $\theta$, top and bottom plates connected to said side wall and having circular-shaped outer edges, a horn mouth located adjacent said outer edges and having an equiphase distribution, and a horn throat located opposite said horn mouth; and a plurality of N equally spaced power distributors radially disposed in said second sectoral horn and extending from said top plate to said bottom plate from said horn mouth to said horn throat, for forming a plurality N+1 of elementary radiation sources.

2. An antenna according to claim 1, further including a plurality of phase shifter, each disposed in said second sectoral horn between adjacent power distributors.

3. An antenna according to claim 1 wherein the amplitude of a field radiated by said second sectoral horn is determined by spacings between adjacent power distributors at said horn throat.

4. An antenna according to claim 1 wherein a spacing between adjacent power distributors at said horn mouth is approximately $\lambda_M/2$, where $\lambda_M$ is the wavelength corresponding to a maximum frequency of the operating frequency band of said antenna.

5. An antenna according to claim 1 wherein said second sectoral horn has a radiating opening width related to said opening angle $\theta$ and a length of said side walls, and wherein said radiating opening width is substantially greater than $\lambda_m$, where $\lambda_m$ is the wavelength corresponding to a minimum frequency of the operating frequency band of said antenna.

6. An antenna according to claim 1 wherein said second sectoral horn is a pyramidal horn sectoral in both $\vec{H}$ and $\vec{E}$ planes.

7. A wide band microwave antenna, comprising:

a rectangular waveguide;

a first sectoral horn coupled to said rectangular waveguide and being sectoral in an $\vec{H}$ plane;

a second sectoral horn being sectoral in an $\vec{E}$ plane and receiving radiation from said first sectoral horn said second sectoral horn having a partial-cylindrical shape and an axis substantially normal to said $\vec{E}$ plane, two side walls forming an opening angle $\theta$, top and bottom plates connected to said side walls and having circular-shaped outer edges, a horn mouth located adjacent said outer edges and having an equiphase distribution, and a horn throat located opposite said horn mouth; and a plurality of N equally spaced power distributors radially disposed in said second sectoral horn and extending from said top plate to said bottom plate from said horn mouth to said horn throat, for forming a plurality N+1 of elementary radiation sources.

8. An antenna according to claim 7 wherein said rectangular waveguide includes a step disposed on each side wall of said rectangular wave guide.

9. An antenna according to claim 8 wherein said first sectoral horn includes a step disposed on each side wall of said first sectoral horn, parallel to said steps in said rectangular waveguide.

10. An antenna according to claim 7 wherein said first sectoral horn is sectoral in both said $\vec{E}$ and said $\vec{H}$ planes.

11. An antenna according to claim 9 wherein said first sectoral horn is sectoral in both said $\vec{E}$ and said $\vec{H}$ planes.

12. A wide-band antenna, comprising:

a rectangular waveguide;

a first sectoral horn coupled to said waveguide, said first sectoral horn being sectoral in a first plane;

a second sectoral horn coupled to said first sectoral horn and sectoral in a second plane substantially orthoganal to said first plane, said second sectoral horn having a partial-cylindrical shape with an axis substantially orthoganal to said second plane, said second sectoral horn having a top plate and a bottom plate; and a plurality of powder distributors radially disposed in said second sectoral horn and extending from said top plate to said bottom plate throughout a radial length of said second sectoral horn.

* * * * *